US006352364B1

(12) United States Patent
Möbs

(10) Patent No.: US 6,352,364 B1
(45) Date of Patent: Mar. 5, 2002

(54) TUBULAR BAG-TYPE PACKING

(75) Inventor: Heinrich-Stephan Möbs, Bad Nauheim (DE)

(73) Assignee: Hassia Verpackungsmaschinen GmbH, Ranstadt (DE)

( * ) Notice: Subject to any disclaimer, the term of this patent is extended or adjusted under 35 U.S.C. 154(b) by 0 days.

(21) Appl. No.: 09/552,603

(22) Filed: Apr. 19, 2000

(30) Foreign Application Priority Data

Apr. 26, 1999 (DE) ..... 299 07 206 U

(51) Int. Cl.[7] ..... B65D 33/00
(52) U.S. Cl. ..... 383/200; 229/87.05
(58) Field of Search ..... 383/200, 201; 229/87.05

(56) References Cited

U.S. PATENT DOCUMENTS 4,139,643 A * 2/1979 Hix et al. ..... 383/200 X
4,778,058 A * 10/1988 Yamazaki et al. ..... 383/200
4,919,271 A 4/1990 Kai et al.
5,222,813 A * 6/1993 Kopp et al. ..... 383/200
6,102,571 A * 8/2000 Moteki et al. ..... 383/201 X

FOREIGN PATENT DOCUMENTS

| | | | |
|---|---|---|---|
| DE | 93 12 664 | 1/1994 | |
| DE | 43 22 572 | 12/1995 | |
| EP | 0 289 209 | 11/1988 | |
| EP | 0 274 514 | 7/1990 | |
| JP | 4042424543 A * | 8/1992 | ..... 383/200 |

* cited by examiner

*Primary Examiner*—Jes F. Pascua
(74) *Attorney, Agent, or Firm*—Collard & Roe, P.C.

(57) ABSTRACT

The invention is concerned with tubular bag-type packings in the form of so-called stickpacs formed of a sealable foil strip of at least one layer which is molded to form a tube provided with a longitudinal sealing joint extending between the side edges of the packing. The tube is sealed by upper and lower transverse sealing joints. In order to enable such stickpacs to be easily and faultlessly opened, in one instance, also in the area of the longitudinal sealing joint, tearing aids are provided, and in another instance, the tube, via a transverse sealing joint, is provided with an extension, with the transverse sealing joint being arranged to extend at an inclination relative to the longitudinal axis of the packing.

4 Claims, 2 Drawing Sheets

TUBULAR BAG-TYPE PACKING

BACKGROUND OF THE INVENTION

1. Field of the Invention

The present invention is concerned with tubular bag-type packings and, in particular, it relates to so-called stickpacs formed from a sealable foil consisting of at least one layer.

2. Description of the Prior Art

Stickpacs of the afore-mentioned type are molded to form a tube provided with a longitudinal sealing joint extending between the side edges of the packing, with the tube being sealed by an upper and a lower transverse sealing joint. Packings of the afore-described type which are of a more or less slim tubular shape for which reason they are called stickpacs, have been disclosed, for example, by German Utility No. 93 12 664. A suitable plastic foil (which, depending of the contents, can also be multi-layered) is employed as the foil material for packings of this type in view of the sealability both of the longitudinal and of the transverse sealing joint. There are several options to design the longitudinal sealing joint, namely in the form of an overlapping seam, a folding seam or a butted seam. In packings wherein the longitudinal sealing joint is formed of abutting foil web edges, the latter are lined and sealed by a so-called inner sealing tape. The said tape, during molding on a shaping tube, automatically enters the tube.

Apart from the fact that stickpacs of the afore-described type can, of course, be transversely cut open by way of scissors, which, however, would not be desirable in sense of an easy handling also in respect of opening such packs, easy and simple ripping of such packs is intended. However, it has proved that this is rendered difficult by the double-layered longitudinal sealing joints because, as a rule, these cannot be readily torn. It should be noted that such stickpacs, for evacuating the contents thereof, frequently are taken directly into the user's mouth; in such cases, the torn-off upper part with the longitudinal sealing joint still attached to the pack substantially affects a proper evacuation.

The provision of a tear groove on the lateral edge of the transverse sealing joints, namely on an expanded section of the transverse joint of the type provided in a bag-type pack according to German Utility Patent No. 43 22 572 is of no assistance to a satisfactory opening of such bag packs because the longitudinal sealing joint seam forms a tearing hindrance.

OBJECTS AND SUMMARY OF THE INVENTION

It is, therefore, a primary object of the present invention to provide a new and improved tubular bag-type packing in the form of a stickpac, wherein the longitudinal sealing joint no longer constitutes a tear hindrance.

A second object of the present invention is to provide a new and improved tubular bag-type packing in the form of a stickpac wherein the transverse sealing joint can be opened in whole while the sealed portion of the longitudinal joint is seized at the same time.

The foregoing and other objects are attained in accordance with one aspect of the invention through the provision of a tubular bag-type packing, wherein a tearing aid in the form of at least one groove is provided on the longitudinal joint in registry with an expanded section of the transverse sealing joint.

This configuration of the invention will remove the tear hindrance caused by the longitudinal sealing joint in that a tearing aid is now arranged pointedly and directly on the longitudinal sealing joint.

If the longitudinal joint is made of longitudinal edges of the foil that are sealed in overlapping relationship, the tearing aid is arranged on the inner foil edge and directed toward the transverse sealing joint.

If the longitudinal sealing joint is made of a so-called inner sealing tape and abutting foil edges, the tearing aid is provided on the inner sealing tape.

Feasibly, in both cases a tear groove may be provided, with advantage, on the longitudinal sealing joints within the expanded portion of the transverse joint, in registry with the tearing aids.

As to the second object mentioned hereinbefore, this object is attained in accordance with the present invention through the provision of a tubular bag-type packing, wherein, following at least one of the transverse welding seams, the tube is provided with an extension which, in turn, is furnished with a tearing aid on at least one of its longitudinal edges, and wherein the transverse joint provided with the extension is formed to extend at an inclination relative to the longitudinal axis or to the longitudinal joint of the tube.

The inclined transverse sealing joint can be in the form of an obtuse-angled seam the tip of which superposes the longitudinal sealing joint.

This will create above the transverse sealing joint two flaps easily seizable by thumb and forefinger of both hands so that when tearing apart these flaps the transverse sealing joint due to the inclined arrangement thereof, easily tears open. This is sort of a banana-type peeling of the pack no longer affected by the longitudinal welding seam.

As to the tearing aids provided on the extension, these can be formed by cut-open longitudinal edges or by perforated longitudinal edges or by laser scores provided on the longitudinal edges yet to be explained in closer detail hereinafter.

BRIEF DESCRIPTION OF THE DRAWINGS

Various objects, features and attendant advantages of the present invention will be more fully appreciated as the same becomes better understood from the following detailed description thereof when considered in connection with the accompanying drawings, wherein.

DETAILED DESCRIPTION OF THE PREFERRED EMBODIMENTS

Figure 1:
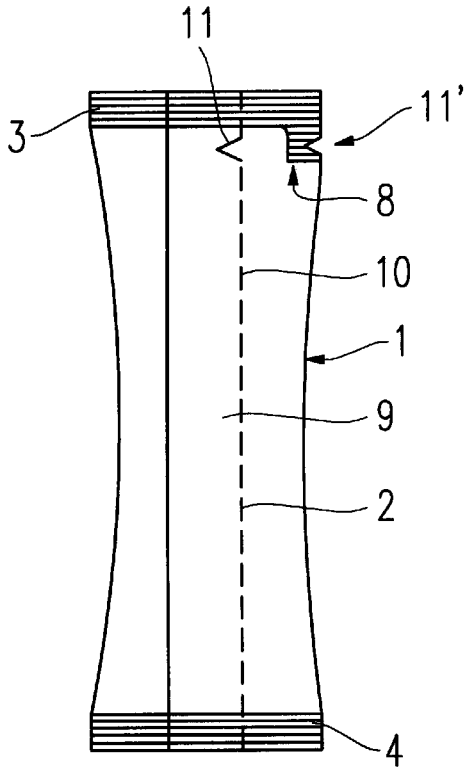
FIG. 1 shows the embodiment of a stickpac with a longitudinal sealing joint formed of overlapping longitudinal edges of the foil.
Figure 2:
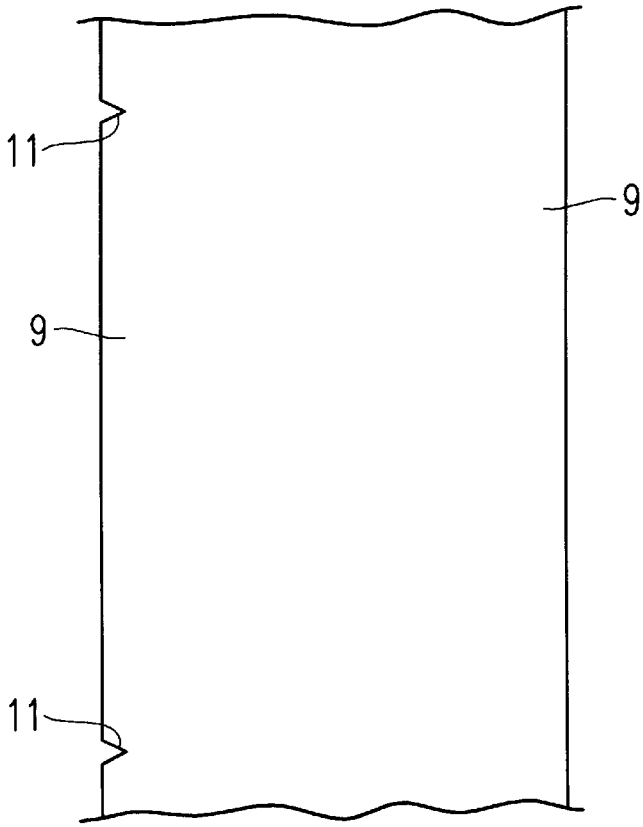
FIG. 2 is the front view of a section of a foil web or a foil strip for the pack according to FIG. 1.

The tubular bag-type packings are made of a foil of at least one layer molded into a tube 1 provided with a longitudinal sealing joint 2, with the tube 1 being sealed by upper and lower transverse sealing joints 3,4. The way of manufacture of such packings will not require any closer explanation as the same is generally known, using conventional tubular bag-making machines.

It is important to the forms of embodiment as shown in FIGS. 1 through 4 that at least one of the transverse sealing joints 3,4 (in the present instance: 3), toward the tube, is provided with a short expanded section 8 of the transverse joint and that a tearing groove 11 forming a tear-open aid is provided at the level of the expansion 8 of the transverse joint on the inner foil edge 10 within the longitudinal joint 2 formed of overlapping foil edges 9.

The tearing aid, hence, in this form of embodiment, is formed by the relatively short expansion 8 of the transverse sealing joint so that, when pulling the same, the crack propagates toward the groove 11 where it readily continues to be torn despite the overlapping longitudinal sealing joint 2. In lieu of one large groove, as shown, it will also be possible to provide a plurality of small grooves.

The grooves 11 in the foil web forming the tube, in accordance with FIG. 2, are again located at a corresponding space, with the foil web entering the tubular bag making machine, from the very start, can be provided with grooves of this type unless the machine is equipped with a corresponding groove punching facility.

Figure 3:
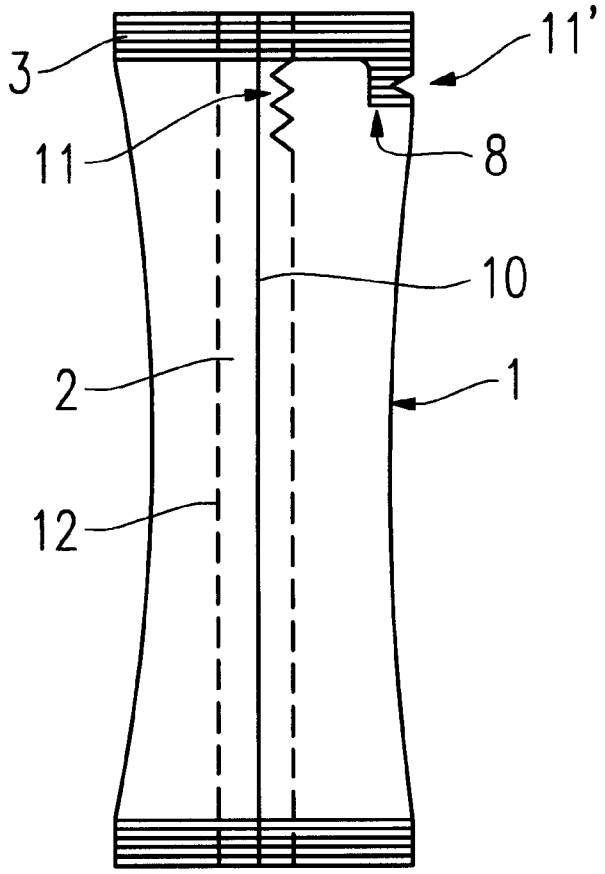
FIG. 3 shows the design of a stickpac with a longitudinal sealing joint formed of an inner sealing tape and the abutting edges of the foil.
Figure 4:
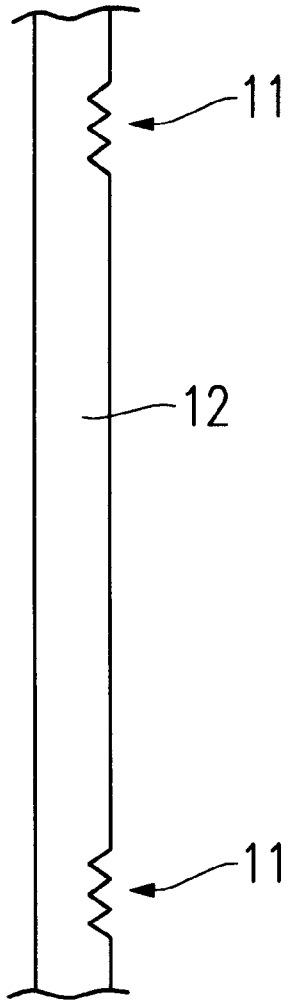
FIG. 4 is a side view of a design of the inner sealing tape for the pack of FIG. 3.

The afore-going applies accordingly to the embodiment of FIG. 3. It is important to the stickpac that at least one of the transverse sealing joints (in the present instance: 3), toward the tube, be also provided with a short expanded section 8 of the transverse sealing joint, and that a plurality of tear grooves 11 (see also FIG. 4) be arranged at the level of the expansion 8 within an inner sealing tape 12 forming together with the abutting foil edges 10 the longitudinal sealing joint seam 2.

Under consideration of the relatively low width of such tapes not permitting the provision of any large grooves 11 as in the embodiment according to FIG. 1, a plurality of small tearing grooves 11 are provided on the inner sealing tape 12 to safeguard that a crack starting from the expansion 8 of the transverse sealing joint does reliably strike a groove.

As shown in FIGS. 1 and 3, a tearing aid 11' is provided at the expanded section 8 of the transverse sealing joint in registry with tearing aid 11.

Obviously, numerous modifications and variations of the present invention are possible in the light of the above teachings. It is, therefore, understood that within the scope of the appended claims, the invention may be practiced otherwise than as specifically described herein.

I claim as may invention:

1. A tubular bag-type packing comprised of a foil strip having two side edges and upper and lower edges extending transversely between the side edges, a longitudinal sealing joint extending between the side edges to form the foil strip into a tube, upper and lower transverse sealing joints sealing the upper and lower edges, at least one of the transverse sealing joints having an expanded section transversely spaced from the longitudinal sealing joint at one side thereof, and a tearing aid in the form of at least one groove provided at the longitudinal sealing joint in transverse registry with the expanded section and inside the tubular bag-type packing.

2. The tubular bag-type packing of claim 1, further comprising a tearing aid in the form of at least one groove provided at the expanded section in transverse registry with the tearing aid on the longitudinal sealing joint.

3. The tubular bag-type packing of claim 1, wherein the side edges are overlapped to form the longitudinal sealing joint.

4. The tubular bag-type packing of claim 1, wherein the side edges abut and a sealing tape extends inside the tubular bag-type packing along the abutting side edges to form the longitudinal sealing joint.

* * * * *